United States Patent [19]

Stahlecker et al.

[11] Patent Number: 4,653,263

[45] Date of Patent: Mar. 31, 1987

[54] PROCESS FOR PIECING YARN ON AN OPEN END SPINNING MACHINE

[76] Inventors: Fritz Stahlecker, Josef-Neidhart-Strasse 18, 7347 Bad Überkingen; Hans Stahlecker, Haldenstrasse 20, 7334 Süssen, both of Fed. Rep. of Germany

[21] Appl. No.: 820,797

[22] Filed: Jan. 22, 1986

[30] Foreign Application Priority Data

Jan. 22, 1985 [DE] Fed. Rep. of Germany ..... 3501875

[51] Int. Cl.[4] ..... D01H 15/00; D01H 15/02; D01H 9/18; D01H 13/24

[52] U.S. Cl. ..... 57/263; 57/22; 57/83; 57/281

[58] Field of Search ..... 57/22, 78, 83, 86, 90, 57/263, 264, 267, 281, 400, 408, 411; 19/0.2, 0.25, 159 A

[56] References Cited

U.S. PATENT DOCUMENTS

| | | | |
|---|---|---|---|
| 3,867,810 | 2/1975 | Meertens et al. | 57/22 X |
| 4,033,104 | 7/1977 | Kamp | 57/281 |
| 4,055,936 | 11/1977 | Raasch | 57/263 |
| 4,055,942 | 11/1977 | Stahlecker | 57/263 |
| 4,078,369 | 3/1978 | Brandis | 57/281 X |
| 4,150,534 | 4/1979 | Raasch | 57/281 |
| 4,156,341 | 5/1979 | Raasch | 57/263 |
| 4,537,018 | 8/1985 | Tooka | 57/264 X |

*Primary Examiner*—Donald Watkins

*Attorney, Agent, or Firm*—Barnes & Thornburg

[57] ABSTRACT

A process is provided for connecting the end of a new fiber band to the end of a fiber band running into an open-end spinning arrangement wherein the threading on is conducted in such a manner that the joining point between the new fiber band and the fiber band already running into the spinning arrangement does not result into a change in the yarn number. In one embodiment it is provided that the fiber bands are prepared in such a manner and connected to each other, especially by means of twisting them together, such that a joining point exhibits at least approximately the same number as the other areas of the fiber band. In a second embodiment, it is provided that following a joining of the two fiber bands the feeding device of the spinning arrangement is switched on until the joining point is running into the spinning arrangement whereby the fibers fed during this time period are transported off within the spinning arrangement.

21 Claims, 5 Drawing Figures

Fig. 3
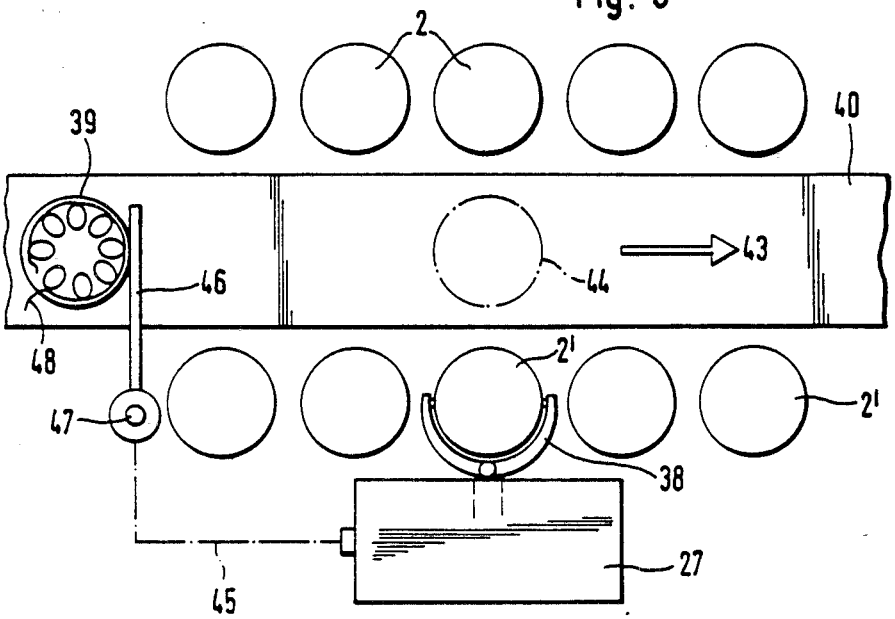
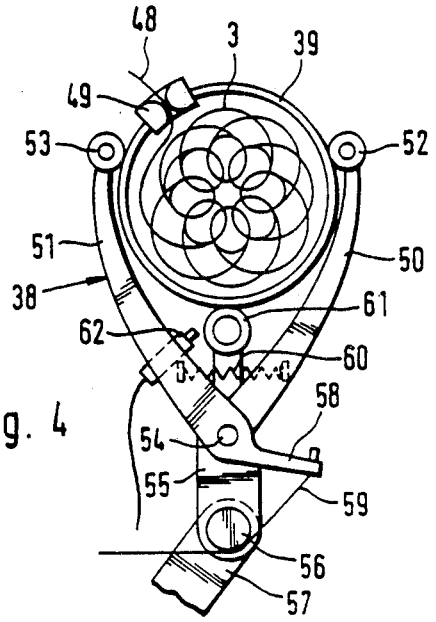
Fig. 4

PROCESS FOR PIECING YARN ON AN OPEN END SPINNING MACHINE

BACKGROUND AND SUMMARY OF THE INVENTION

The present invention relates to a method for connecting the end of a new fiber band to the end of a fiber band running into an open-end spinning arrangement. The end of the running fiber band is drawn off by a feeding device of the spinning arrangement and the new fiber band is drawn from a container and threaded into the spinning arrangement. The feeding device is brought to a standstill whereupon the end of the new fiber band is attached followed by an automatic start spinning of the spinning device.

In a method of the above-mentioned kind as disclosed in German application DE-OS No. 25 18 224, it is provided that the presence or absence of a running fiber band is determined by means of a touch sensor which is arranged at least one staple length in front of the inlet of the fiber band into an opening device. The intention here is to prevent a yarn number from being spun which differs from the rest of the yarn after the fiber band has been used up. The end of the new fiber band is then connected by hand whereupon an automatic start spinning takes place. Although it is prevented that too thin a yarn is spun just prior to using up the running fiber band, too large a fiber amount is introduced when connecting the end of the new fiber band. This results in at first a thicker yarn being spun prior to entirely using up the old fiber band following the automatic start spinning process.

It is also known, as disclosed in German application DE-OS No. 25 21 851, to fill up all the containers with the same lengths of fiber bands and to provide a measuring device which measures the introduced length of the fiber band and determines the time period for connecting a new fiber band. A separating device is thereby provided immediately in front of the feeding device by means of which the old fiber band is cut off whereby the same is subsequently still introduced into the spinning device in its entirety. Presumably this results in a thickening portion at the yarn end which is easily detected on the spool during the subsequent start spinning process. The joining of the end of the new fiber band occurs by a direct, manual introduction into the spinning device.

Furthermore, it is known, as disclosed in JP-OS No. 59-76 932, to indirectly determine the respective contents of a container stocked with the fiber band whereby the respective filling level is determined by counting the rotation of the yarn withdrawal rollers or the take-up spool. The idle times during yarn breaks and spool exchanges are deducted. From these values conclusions can be drawn as to the respective content of the fiber band containers so that a signal is given for changing a container as needed.

It is also known according to German DE-OS No. 25 54 915 to watch the content of the containers directly, for example by measuring the running length of the fiber band at the delivery device, or by measuring the weight decrease of the container, or by measuring the filling height. As a lower limiting value is reached, a signal is given that allows one to exchange the almost empty fiber band containers in good time prior to the start of a longer, maintenance free period, as for example prior to a weekend.

An object of the present invention is to provide a process of the above-mentioned kind that enables a fully automatic joining of a new fiber band whereby at the same time it is guaranteed that no faulty portions exist in the spun yarn due to the joining of the new fiber band.

In a first embodiment of the present invention it is provided that the feeding device is brought to a still stand prior to the entry of the end of the fiber band into the spinning device. Thereupon the fiber band protruding from the spinning device and/or the end of the new fiber band are treated in such a manner and connected to each other that the connecting point results in at least a similar if not substantially the same yarn number as the other areas of the fiber band.

This arrangement makes it possible to obtain a constant yarn number in the fiber band following a connecting of the new fiber band so that correspondingly the spun yarn is also constant. In a preferred development of the invention it is provided that the end of the fiber band made available is spliced with the end of the fiber band protruding from the spinning device.

In another embodiment it is provided that the feeding device of the spinning device is brought to a standstill prior to the entry of the end of the fiber band into the spinning device, thereby allowing the end of the new fiber band to be connected to the end of the fiber band protruding from the spinning device. Subsequently to the joining of the ends of the old and new fiber bands, the feeding device of the spinning device is switched on only as long as the joining position is running into the spinning device. The fibers introduced during this time period are transported off by the spinning device whereupon the automatic start spinning process is activated. With this arrangement, the quality of the joining position between the end of the new fiber band and the end of the old fiber band does not matter since the fibers existing in the area of this joining point are not spun into the yarn but transported off as waste material. There is also provided a pneumatic splicing or twisting with this kind of fiber band connection. However, since in this case the joining position has no influence upon the yarn quality, less elaborately designed connections may also be provided. For example, a simple rubbing together of the end of the new fiber band with the end of the old fiber band.

Both of the embodiments exhibit the advantage that the old fiber band is not spun to its very end prior to attaching and introducing a new fiber band. Consequently, the end of the old fiber band has no influence upon the spun yarn quality. Since a sufficiently long piece of the old fiber band still protrudes out of the spinning device at the time of joining the new fiber band, the joining process can be fully automated with relatively simple means.

In order to proceed with the stopping of the feeding device of a spinning device in good time prior to running through the end of the fiber band in the spinning device, a further development of the invention provides that a sufficiently long piece of fiber band remains in the containers and that the spinning device includes a measuring device for determining the run-in length of the fiber band. This device is coupled with a device for bringing the feeding device of the spinning device to a standstill. For the same purpose there is provided in another development of the invention that the fiber bands deposited in the containers are provided with a marking at a distance from their ends, and that the spinning device is provided with a device for recognizing the marking and activating a device for bringing the feeding device to a standstill. This kind of marking, whether it is of a chemical, optical, or mechanical nature, does not require the deposit of an exactly measured length of fiber band in the containers.

In a further development of the invention for executing the process at a spinning machine with a plurality of open-end spinning devices, which each contain a feeding device for drawing in a respective fiber band presented out of a container, it is provided, that each spinning device is equipped with a device switching off the fiber feeding device for measuring the length of the fiber band run-in to the spinning device. Furthermore there is provided a movable maintenance apparatus assigned to respectively one spinning device which is equipped with devices for picking up and connecting the fiber band protruding from the spinning device with the end of a new fiber band.

Especially since the old fiber band protrudes out of the spinning device with a substantially long piece while the feeding device has already been switched off, the joining with the end of a new fiber band is done fully automatically in a very simple manner.

Other objects, advantages and novel features of the present invention will become apparent from the following detailed description of the invention when considered in conjunction with the accompanying drawings.

BRIEF DESCRIPTION OF THE DRAWINGS

FIG. 3 is a partial top view of a transport arrangement for fiber band containers and the maintenance device in accordance with the present invention;

FIG. 4 is a top view of an individual feature of the maintenance device; and

DETAILED DESCRIPTION OF THE DRAWINGS

Figure 1:
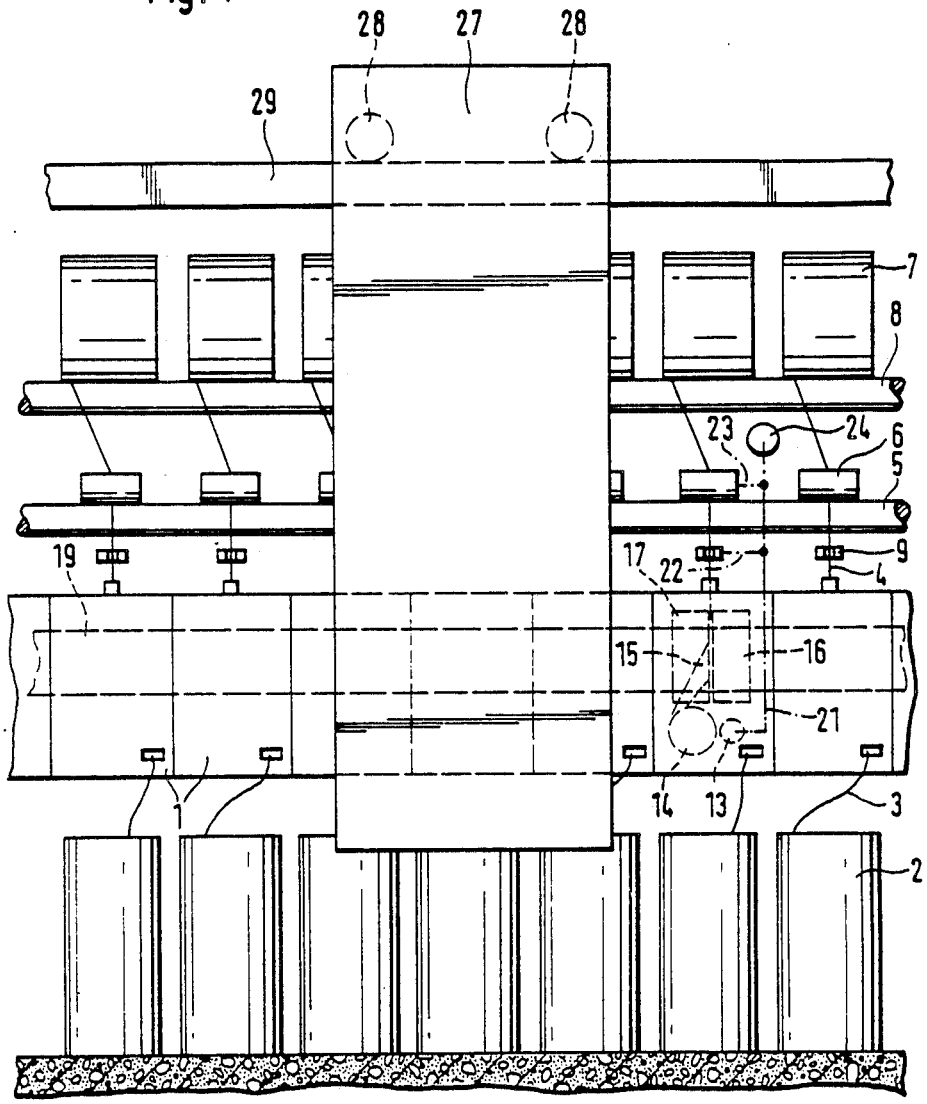
FIG. 1 shows a front view of a portion of a spinning machine arranged as an open-end friction spinning machine having a plurality of spinning units and a movable maintenance device for the automatic introduction of the fiber bands and the automatic start-spinning in accordance with the present invention.

The invention is described in detail with respect to an open-end friction spinning machine, but the invention may be successfully used with all other kinds of open-end spinning processes especially also with an open-end rotor spinning process.

The spinning machine includes a plurality of spinning units that are arranged next to one another and which are adjacently positioned in a row on either side of the machine. Each spinning unit 1 includes a fiber band container 2 comprising a can which contains a fiber band 3 for introduction into the respective spinning unit 1, wherein it is spun to a yarn 4. The yarn 4 is drawn off the spinning unit 1 by means of a yarn withdrawal device formed by a withdrawal roller pair 5, 6, and is subsequently spooled upon a winding spool 7. One of the withdrawal rollers 5 is arranged as a drawing roller continuously driven shaft extending in the machine longitudinal direction, which coordinates with a withdrawal roller 6 arranged as press roller at each individual spinning device 1. The winding spools 7 of the spinning devices 1 are driven continuously by means of a take-up shaft extending in the machine longitudinal direction of the machine. Each spinning device 1 includes a yarn detector 9 which signals any breakage of the yarn 4 and discontinues further feeding of the fiber band in response to yarn breakage. The winding spools 7 of each of the spinning devices 1 are retained in spool frames 10 which are pivotably held about stationary axles 11 at a machine frame 12 which is in the form of a mounting wall as can be seen from FIGS. 2 and 5.

Figure 2:
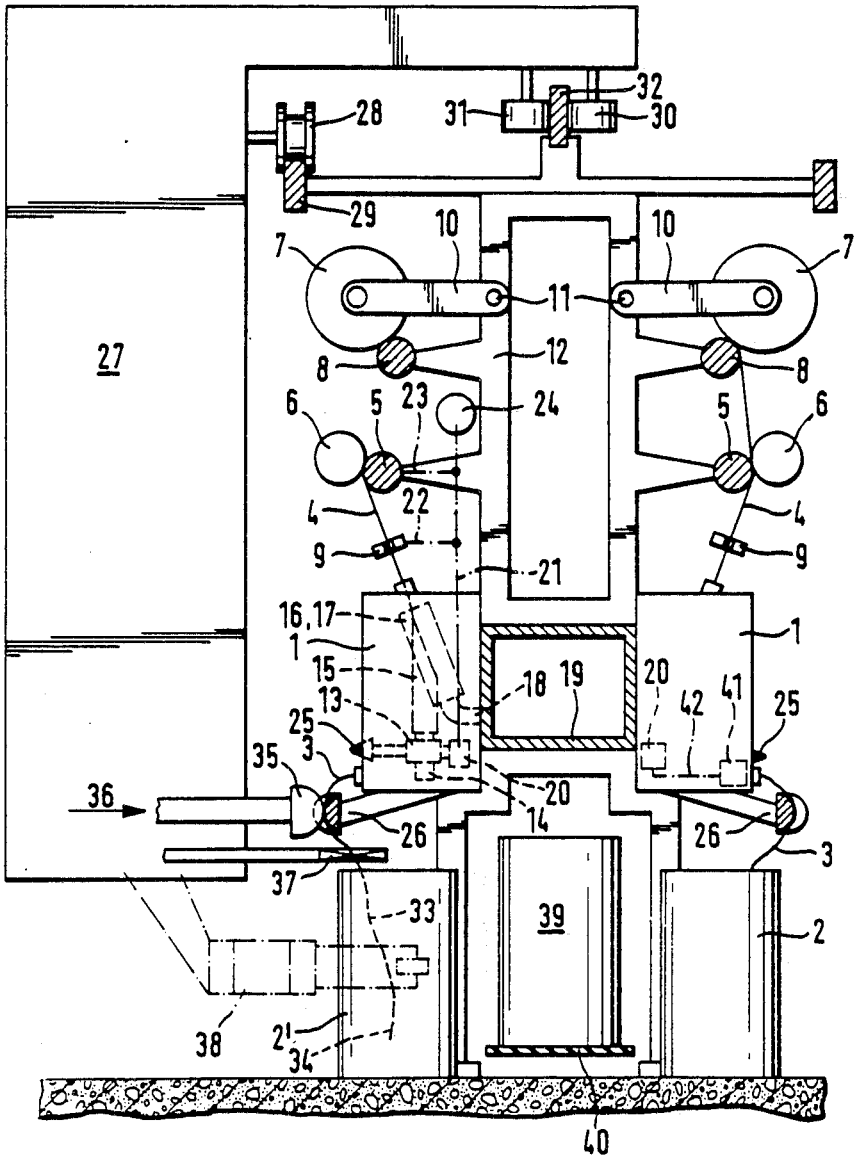
FIG. 2 is a cross-sectional view through the spinning machine of FIG. 1 with a partial, sectional side view of a spinning unit, at which a maintenance device is engaged.
Figure 5:
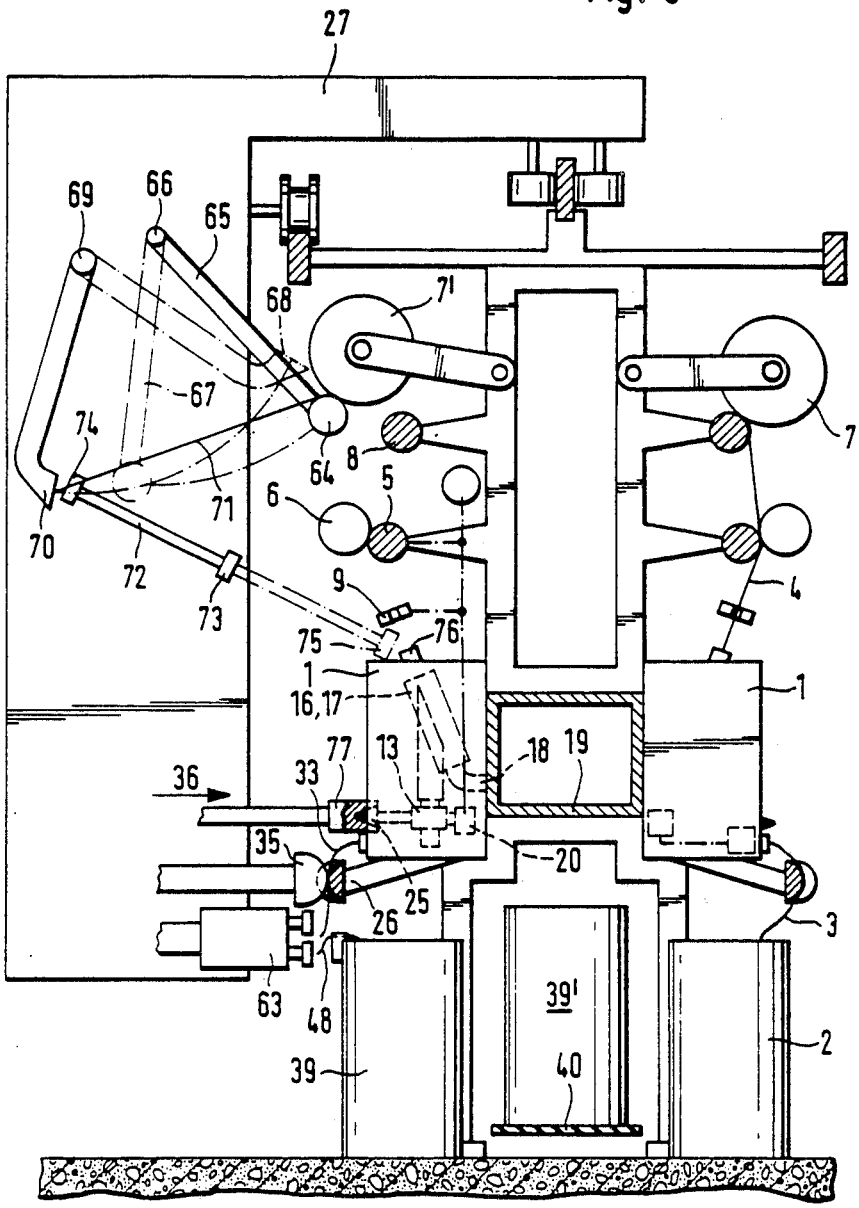
FIG. 5 is a view similar to FIG. 2 including additional maintenance device means for the operation of an automatic start-spinning process in accordance with the present invention.

Each spinning device includes a spinning arrangement in which a feeding roller 13 is shown respectively in FIGS. 1, 2 and 5. This roller cooperates with a feeding table which is not shown. The feeding arrangement including the feeding roller 13 draws off a fiber band 3 from the fiber band container 2 and introduces the band into the spinning device 1. The feeding arrangement offers the fiber band 3 to a faster rotating opening roller 14 which combs the end of the fiber band 3 into a fiber beard and opens the band into single fibers. The single fibers are then supplied through a fiber feeding channel 15 to the wedge-shaped gap of a roller pair formed by rollers 16 and 17 which are arranged parallel and adjacent to each other and are driven in the same rotational direction in a manner not shown. The supply fibers are twisted into yarn 4 in the wedge-shaped gap which yarn 4 is withdrawn by means of a withdrawal device formed by a pair of yarn withdrawal rollers 5, 6. At least one of the insides of rollers 16 or 17 is connected to a vacuum channel 19 extending through the machine longitudinal direction via suction devices that are not shown. At least one of the rollers 16 or 17 of each of the spinning devices 1 are connected to the vacuum channel 19. The channel 19 is connected to a vacuum source, for example to a ventilator arranged within the machine head and not shown. A suction device 18 is connected to the vacuum channel 19 additionally for each spinning device 1 which is equipped (in a manner not further described) with a blocking valve to be activated from the outside, and which is directed upon the wedge-shaped gap between the two rollers 16 and 17.

The feeding rollers 13 of the spinning devices 1 on one side of the machine are operated by a central drive (in a manner not further described) which in the first instance contains a shaft extending in the machine longitudinal direction to which is connected a drive means leading via correspondingly arranged toothed wheels to the feeding rollers 13. This drive means includes an electromagnetic coupling 20 connectd to the yarn detector 9 of the spinning device 1 via electrical lines 21 and 22. The yarn detector 9 detects a yarn breakage and acts upon this by opening the coupling 20 of the corresponding feeding roller 13 whereby with the occurrence of such a yarn break, the operation of the respective feeding roller 13 is individually interrupted without a disturbance to the central drive. Simultaneously with the discontinued operation of the feeding roller 13 at a spinning device 1, the further supply of the respective fiber band 3 at this spinning device 1 is immediately interrupted. Furthermore, each feeding roller 13 is additionally provided with a gear wheel 25 accessible from the outside which serves to drive the feeding roller 13 of an individual spinning device 1 by means of an auxiliary device 77 even during the opened coupling 20, as discussed later in greater detail.

Each spinning device 1 is additionally equipped with a guiding means 26 for the introduced fiber band 3 which is arranged at a specific point in distance to and below the inlet of the fiber beard 3 in the spinning device 1. Each spinning device 1 further contains a measuring means 24 which is connected via an electrical line 23 to the drawing roller 5 of the yarn withdrawal device by means of a not further described signal transmitter. The drawing roller is in turn connected to coupling 20. This measuring means 24, on the one hand, measures the length of yarn 4 spooled upon the winding pool 7, while at the same time the length of the fiber band 3 removed from the fiber band container 2, and thereby run through the spinning device 1, is indirectly determined. Therefore, if a predetermined length of fiber band 3 filled in the fiber band containers 2, the filling level of each fiber band container 2 may be determined, and it is determined when the contents of the fiber band container 2 has been used up or is about to be used up. It is also contemplated that a measuring means be connected with coupling 20, which measures directly the rotations of the feeding roller 13 and thereby directly determines the length of the fiber band 3 that has been used. In accordance with both embodiments, it is provided that in good time prior to the complete consumption of the old fiber band 3, coupling 20 of the feeding roller 13 is opened, so that a substantial length of the old fiber band 3 protrudes out of the spinning device 1, and especially that a portion 33 and its actual end 34 still remains in the fiber band container 2. This condition is shown in FIG. 2 for the fiber band container 2' of a spinning device 1.

In a further arrangement of the invention, which is shown in FIG. 2 on the right side, a detector is arranged in the area of the inlet of the fiber band 3 in the spinning device 1 which is connected to coupling 20 of the feeding roller 13. This embodiment provides for a marking of the fiber band 3 at a certain distance from its end, detectable by means of the detector 41. When this marking reaches detector 41, the detector activates an opening of the electromagnetic coupling 20 of the feeding roller 13 so that also with this embodiment the feeding device is brought to a standstill prior to the end of the fiber band 3 having run into the spinning device 1. The fiber band 3 then still protrudes with a substantial length out of the spinning device 1 and is located still in the area of guidance means 26.

When the spinning device 1 is brought to a standstill just prior to the complete consumption of the fiber band 3, as it has been described above, the attachment of the beginning of a new fiber band is performed fully automatically by means of a maintenance device 27. The maintenance device 27, which additionally includes means for activating a new start spinning process is called by a corresponding signal of the spinning device 1 which will be discussed in the following. It is advantageously provided that this signal is distinctly different from the signal produced by a yarn breakage so that the maintenance device 27 will not conduct an unnecessary start-spinning operation.

The maintenance device 27 is movable in the longitudinal direction of the spinning machine by means of rotor disks 28 of which at least one is driven. The rotor disks 28 rotate over a drive rail or track 29 which extend around the spinning machine. The maintenance device 27 is additionally supported against a rail or track 32 located in the center of the machine by means of freely rotating wheel 30. The maintenance device 27 advances first to the respective spinning device 1. Subsequently, a fiber band clamp 35 arranged upon a needle extends in arrow direction 36 which fixes fiber band 3 against the guidance means 26. A cutting arrangement 37 extends subsequently also in arrow direction 36 which cuts off portion 33 of the fiber band 3 with its end 34, which portion remains still in the fiber band container 2'. The cut off section of the fiber band falls back into the fiber band container 2'. Thereby the end 34 of the fiber band 3 which contains, due to manufacturing reasons, no exact predetermined amount of fibers, is removed. The end 34, if used, could cause a possible change of the yarn number of the yarn 4 to be spun. Subsequently thereto, the maintenance device 27 positions a gripping device or hand 38 shown in dotted lines in FIG. 2, to the empty fiber band container 2', which in turn removes this fiber band container 2'.

A conveyor belt 40 is arranged in the center of the machine which extends in the longitudinal direction of the machine and serves to remove empty fiber band containers 2' and to make available filled fiber band containers 39 as it is shown in detail in FIG. 3. The extendable, upwardly and downwardly mobile hand 38 positions the empty fiber band container 2' at a position 44 which is generally unoccupied upon the conveyor belt 40 driven in the arrow direction 43. The maintenance device 27 includes a signal line embedded in the area of the drive rail or track 29 and connected with an order or calling device 46 and 47 which then requests a full fiber band container 39 from the machine end. The conveyor belt 40 then transports this filled fiber band container 39 into the area of the respective spinning device at which point the hand 38 removes the same and places it on the location where earlier the empty fiber band container 2' was located.

Referring to FIG. 4, the gripping device or hand 38 of the maintenance device 27 includes two tong-like arms 50 and 51 which surround the fiber band container 39 and which include rollers 52 and 53 at its ends which support each other against the circumference of the fiber band container 39. The tong-like arms 50 and 51 are pivotable about an axis 54 relative to each other. The axis 54 is arranged upon a lever 55 which in turn is pivotable about an axis 56 and attached to a lever arm 57. The lever arm 57 is connected (in a manner not described) to a lifting and lowering device. The tong-like arm 51 is lengthened beyond axis 54 by means of an extension 58 to which a tensioning belt 59 is attached which is led about axis 56. An expansion spring 60 is arranged between the two tong-like arms 50 and 51 against the effect of which and by activating the tensioning belt 59, the tong-like hand 38 is closed. An additional roller 61 at the hand 38 is provided in a position centered between the two rollers 52 and 53 in one corner point of an almost equilateral triangle, against which the circumference of the fiber band container 39 is supported. This roller 61 is rotatable by means of a drive motor so that the fiber band container 39 is turned between the three rollers 52, 53 and 61. A clamp 49 is provided at the edge of the fiber band container 39 which grabs the beginning 48 of fiber band 3 existing in the fiber band container 39. The gripping device or hand 38 is further provided with a sensor 62 which responds to clamp 49 to then switch off the motor of roller 61. The clamp 49 and thereby the beginning 48 of the fiber band 3 of the fiber container 39 is thereby brought into a defined position. In this defined position, the fiber band container 39 is set down in the area of the spinning device 1 in which the beginning 48 of the new fiber band 3 is connected to portion 33 of the introduced fiber band 3 which hangs out of the spinning device 1.

In FIG. 5, a fiber band container 39 has been moved into a defined position for the spinning device 1 at the left side of the machine in the drawing, whereby the beginning 48 of the new fiber band 3 contained therein is in a definite position relative to the maintenance device 27. The portion 33 of the introduced fiber band retained by clamp 35 and the guidance means 26, is also in a defined position. A device 63 which is only schematically depicted for the connecting process is then moved to these two parts. With a first embodiment of the invention means for preparing and pneumatically splicing together the fiber bands are provided for this device 63 whereby a connection is produced such that the connecting point exhibits at least approximately the same amount of fibers as any other area of the fiber band 3. This yields a connection region having at least approximately the same number as the other regions of the fibre band. The same maintenance device 27 subsequently proceeds with an automatic start-spinning process which is yet to be described.

With a second embodiment of the invention it is provided that the device 63 produces any kind of connection between the portion 33 of the running fiber band 3 and the beginning 48 of the new fiber band, for example, a rubbing connection. Having accomplished this connection, the clamp 35 is withdrawn. The gear wheel 25 of the feeding roller 13 is then engaged with an auxiliary drive 77 of the maintenance device 27 in arrow direction 36 which is switched on for a length of time until the joining or connecting point between the beginning 48 of the new fiber band and the section 33 has passed into the spinning device 1 and has been opened by means of the opening rollers of the spinning device 1. This occurs still prior to the actual start spinning. The fibers being opened during this time are removed from the area of the wedge-shaped gap between rollers 16 and 17 by means of the suction device 18 so that a perfectly dimensioned fiber band is presented for the following automatic start-spinning process.

The maintenance device 27 includes a lift-off roller 64 driven in either rotational direction which is arranged upon lever 65 pivotally held about an axis 66. The winding spool 7 is lifted off the take-up roller 8 into position 7′ by means of the lift-off rollers. A thread detector nozzle 70 which is pivotable about an axis 69 is brought to the winding spool 7 in the dotted-lined position 68. The lift-off roller 64 is driven in the direction of yarn withdrawal so that the thread detector nozzle located in position 68 can take-up the torn yarn end and move back subsequently into position 7 so that the yarn end is tensioned between the lift-off roller 64 and the detector nozzle located in its position 70. The tensioned yarn end 71 is taken over by a yarn feeder 72 especially subsequently to cutting the same into length and preparing of the yarn end. The yarn feeder 72 is pivotable about an axis 73 and includes a gripping element 74 which is advantageously formed by a pair of clamping rollers which are driven in either rotational direction and which is pivotable about axis 73 into position 75 shown in dotted lines so that the conditioned yarn end lays opposite a yarn withdrawal channel 76 of the spinning device 1. Subsequently thereto, the yarn end 71 is returned into the area of the wedge-shaped gap of rollers 16 and 17 by spooling-up the same from the winding spool 7′ by means of the lift-off roller 64, on the one hand, and, on the other hand, by the clamping roller pair driven also in reverse of the gripping element 74 which is located in position 75. The maintenance device 27 controls the fiber supply during the start-spinning process via the auxiliary drive 77 which collaborates with the gear wheel of the feeding roller 13, while the wedge-shaped gap of roller 16 and 17 is supplied with newly opened fibers which are then after being spun into a yarn drawn off the clamping roller pair of the gripping element 74 and spooled up subsequently by means of the lift-off roller 64 upon spool 7′. Clamp 35 is in good time moved away from the guidance means 26. After a successful start-spinning process, yarn 4 is then returned to the operational parts of the spinning device 1, which means to the yarn withdrawal arrangement 5, 6, whereby simultaneously the winding spool 7 is rested upon take-up roller 8.

From the preceding description of the preferred embodiments, it is evident that the objects of the invention are attained, and although the invention has been described and illustrated in detail, it is to be cleanly understood that the same is by way of illustration and example only and is not to be taken by way of limitation. The spirit and scope of the invention are to be limited only by the terms of the appended claims.

We claim:

1. A process for connecting an end portion of a new fiber band to an end portion of a running fiber band in an open-end spinning arrangement, said end portion of said running fiber band being drawn off by a feeding device of said spinning arrangement, said end portion of said new fiber band being drawn from a container and threaded into said spinning arrangement, comprising:

stopping said feeding device prior to running said end portion of said running fiber band into said spinning device, thereby leaving said end portion of said running fiber band protruding from said spinning arrangement treating at least one of said end portion of the running fiber band and said end portion of the new fiber band prior to connecting said end portion at a joining point, said treating causing yarn subsequently spun from said joining point to exhibit a yarn number similar to yarn spun from other areas of said fiber band, and connecting said end portion of said running fiber band with said end portion of said new fiber band to form a joining point.

2. A process according to claim 1, further comprising conducting an automatic start spinning step after connecting said end portions.

3. A process according to claim 1, wherein said treating step comprises splicing together said end portion of said new fiber band with said end portion of said running fiber band.

4. A process according to claim 1, wherein said end portion of said running fiber band protruding from said spinning arrangement is separated prior to connecting said new fiber band and said running fiber band.

5. A process according to claim 1, further comprising:

stocking said container with a premeasured length of fiber band, measuring a length of fiber band already introduced into said spinning arrangement, and discontinuing operation of said feeding device in response to measuring a preselected length of fiber band introduced into said spinning arrangement.

6. A process according to claim 1, further comprising:

marking new fiber bands deposited in said container at a distance from their ends, sensing said marking as one of said fiber bands passes through said spinning arrangement, and discontinuing operation of said feeding device in response to sensing of said marking.

7. A process for connecting an end portion of a new fiber band to an end portion of a running fiber band in an open-end spinning arrangement, said end portion of said running fiber band being drawn off by a feeding device of said spinning arrangement, said end portion of said new fiber band being drawn from a container and threaded into said spinning arrangement, comprising:

stopping said feeding device prior to running said end portion of said running fiber band into said spinning device, thereby leaving said end portion of said running fiber band protruding from said spinning arrangement connecting said end portion of said running fiber band with said end portion of said new fiber band to form a joining point, turning on the feeding device of the spinning arrangement until said joining point runs into said spinning arrangement, removing fibers supplied to said spinning arrangement while said feeding device is turned on, and conducting an automatic start spinning operation.

8. A process according to claim 7. wherein said end portion of said running fiber band protruding from said spinning arrangement is separated prior to connecting said new fiber band and said running fiber band.

9. A process according to claim 7. further comprising:

stocking said container with a premeasured length of fiber band, measuring a length of fiber band already introduced into said spinning arrangement, and discontinuing operation of said feeding device in response to measuring a preselected length of fiber band introduced into said spinning arrangement.

10. A process according to claim 7, further comprising:

marking new fiber bands deposited in said container at a distance from their ends, sensing said marking as one of said fiber bands passes through said spinning arrangement, and discontinuing operation of said feeding device in response to sensing of said marking.

11. An open end spinning arrangement having a plurality of open-end spinning devices, each said device being provided with a feeding device for withdrawing a fiber band out of a container, comprising:

measuring means for measuring the length of said fiber band introduced into the spinning device, said measuring means being capable of turning off said feeding device, and movable maintenance device means being assignable to one spinning device, said maintenance device means being equipped with picking up and connecting means for picking up and connecting an end portion of a running fiber band protruding from the spinning device with an end portion of a new fiber band.

12. An arrangement according to claim 11, wherein said picking up and connecting means includes twisting device means and treating means for treating one of an end portion of a new fiber band and an end of a running fiber band.

13. An arrangement according to claim 11, wherein said picking up and connecting means includes twisting device means and treating means for treating an end portion of a new fiber band and an end portion of a running fiber band.

14. An arrangement according to claim 11, wherein said maintenance device means includes switching on means for switching on the feeding device of the spinning arrangement.

15. An arrangement according to claim 14, wherein each spinning device includes removing means for temporarily removing fiber material introduced into the spinning device.

16. An arrangement according to claim 11, wherein said maintenance device means includes picking up means for picking up a container stocked with new fiber band and for exchanging said container stocked with new fiber band for a second container stocked with fiber band running into said spinning device.

17. An arrangement according to claim 16, wherein said maintenance device means includes position adjusting means for adjusting the position of the container stocked with the new fiber band relative to one of the spinning device and the picking up and connecting means.

18. An arrangement according to claim 11, wherein each spinning device is provided with guidance means for guiding a fiber band entering the spinning device, said guidance means being capable of being coupled with a clamp device of the maintenance device means.

19. An arrangement according to claim 11, wherein said maintenance device means includes activating means for activating an automatic start spinning operation.

20. An open-end spinning apparatus including spinning surface means for spinning yarn from fibers band and feeding device means for feeding fiber band to said spinning unit comprising:

stopping means for stopping said feeding device means prior to running an end portion of a running fiber band into said spinning unit, treating means for treating at least one of said end portion of said running fiber band and an end portion of a new fiber band to be fed into said spinning unit, and connecting means for connecting said end portion of said running fiber band with an end portion of a new fiber band.

21. An open-end spinning apparatus including spinning surface means for spinning yarn from fibers band and feeding device means for feeding fiber band to said spinning unit comprising:

stopping means for stopping said feeding device means prior to running an end portion of a running fiber band into said spinning unit, connecting means for connecting said end portion of said running fiber band with an end portion of a new fiber band, activating means for activating the feeding device means of the spinning unit until said joining point runs into said spinning unit, and removing means for removing fibers supplied to said spinning unit while said feeding device means is activated on.

* * * * *